US007278358B2

(12) United States Patent
Huffman

(10) Patent No.: US 7,278,358 B2
(45) Date of Patent: Oct. 9, 2007

(54) NON-LETHAL MARKING BULLET FOR RELATED TRAINING CARTRIDGES

(75) Inventor: Rick Huffman, Redwood Valley, CA (US)

(73) Assignee: PDT Tech, LLC., Alamo, CA (US)

( * ) Notice: Subject to any disclaimer, the term of this patent is extended or adjusted under 35 U.S.C. 154(b) by 351 days.

(21) Appl. No.: 10/846,883

(22) Filed: May 14, 2004

(65) Prior Publication Data

US 2005/0183613 A1 Aug. 25, 2005

Related U.S. Application Data

(60) Provisional application No. 60/539,022, filed on Jan. 22, 2004.

(51) Int. Cl.
*F42B 12/40* (2006.01)

(52) U.S. Cl. ..... 102/502; 102/439; 102/444; 102/513; 102/529

(58) Field of Classification Search ..... 102/439, 102/444, 502, 512, 513, 508, 509, 529
See application file for complete search history.

(56) References Cited

U.S. PATENT DOCUMENTS

| | | | | | |
|---|---|---|---|---|---|
| 3,429,263 | A | * | 2/1969 | Lont et al. | 102/513 |
| 3,650,213 | A | * | 3/1972 | Abbott et al. | 102/436 |
| 3,776,137 | A | * | 12/1973 | Abbott | 102/431 |
| 3,865,038 | A | * | 2/1975 | Barr | 102/502 |
| 3,952,662 | A | | 4/1976 | Greenlees | 102/92.7 |
| 3,982,489 | A | | 9/1976 | Flatau et al. | 102/92.4 |
| 4,262,597 | A | | 4/1981 | Olson | 102/92.6 |
| 4,270,293 | A | | 6/1981 | Plumer et al. | 42/1 F |
| 4,899,660 | A | | 2/1990 | Brighton | 102/447 |
| 5,009,164 | A | * | 4/1991 | Grinberg | 102/502 |
| 5,016,536 | A | | 5/1991 | Brighton | 102/430 |
| 5,035,183 | A | | 7/1991 | Luxton | 102/502 |
| 5,121,692 | A | | 6/1992 | DiCarlo | 102/439 |
| 5,219,316 | A | | 6/1993 | Huffman | 472/62 |
| 5,221,809 | A | | 6/1993 | Cuadros | 102/439 |
| 5,353,712 | A | * | 10/1994 | Olson | 102/513 |
| 5,359,937 | A | | 11/1994 | Dittrich | 102/430 |
| 5,492,063 | A | | 2/1996 | Dittrich | 102/430 |
| 5,520,019 | A | | 5/1996 | Schuetz | 42/49.02 |
| 5,565,649 | A | * | 10/1996 | Tougeron et al. | 102/502 |
| 5,652,407 | A | | 7/1997 | Carbone | 102/438 |
| 5,654,524 | A | * | 8/1997 | Saxby | 102/513 |
| 5,740,626 | A | | 4/1998 | Schuetz et al. | 42/106 |
| 5,791,327 | A | | 8/1998 | Riggs et al. | 124/471 |

(Continued)

FOREIGN PATENT DOCUMENTS

FR 2762385 A1 * 10/1998

(Continued)

*Primary Examiner*—James S. Bergin
(74) *Attorney, Agent, or Firm*—Jackson & Co., LLP; Andrew V. Smith

(57) ABSTRACT

A projectile of non-lethal composition includes an outer casing that is substantially sealed prior to impact with a target both when the projectile is in a static condition and when the projectile is in a dynamic condition. A marking material is encapsulated within the outer casing prior to impact. The outer casing is configured to deform and unseal upon impact such that the marking material disperses forward via hydraulic action.

44 Claims, 4 Drawing Sheets

U.S. PATENT DOCUMENTS

| | | | | |
|---|---|---|---|---|
| 5,962,806 | A | 10/1999 | Coakley et al. | 102/502 |
| 5,965,839 | A | 10/1999 | Vasel et al. | 102/502 |
| 5,974,942 | A | 11/1999 | Dionne | 89/194 |
| 5,983,548 | A | 11/1999 | Ludaescher | 42/1.08 |
| 5,983,773 | A | 11/1999 | Dionne | 89/29 |
| 6,209,461 | B1 | 4/2001 | Riffet et al. | 102/513 |
| 6,230,630 | B1 | 5/2001 | Gibson et al. | 102/513 |
| 6,250,226 | B1 | 6/2001 | Leichter et al. | 102/370 |
| 6,276,252 | B1 | 8/2001 | Dionne | 89/29 |
| 6,295,933 | B1 | 10/2001 | Dubocage et al. | 102/439 |
| 6,302,028 | B1 | 10/2001 | Guillot-Ulmann et al. | 102/502 |
| 6,357,331 | B1 | 3/2002 | Dionne | 89/29 |
| 6,374,741 | B1 | 4/2002 | Stanley et al. | 102/439 |
| 6,378,439 | B1 * | 4/2002 | Saxby | 102/513 |
| 6,393,992 | B1 | 5/2002 | Vasel et al. | 102/502 |
| 6,415,718 | B1 | 7/2002 | Saxby | 102/446 |
| 6,442,882 | B1 | 9/2002 | Dionne | 42/77 |
| 6,543,365 | B1 | 4/2003 | Vasel et al. | 102/502 |
| 6,546,874 | B2 | 4/2003 | Vasel et al. | 102/444 |
| 6,553,913 | B1 | 4/2003 | Wardlaw | 102/501 |
| 6,564,719 | B2 | 5/2003 | Saxby | 102/446 |
| 6,604,946 | B2 | 8/2003 | Oakes | 434/11 |
| 6,615,739 | B2 | 9/2003 | Gibson et al. | 105/513 |
| 6,619,211 | B1 * | 9/2003 | Haeselich | 102/513 |
| 6,625,916 | B1 | 9/2003 | Dionne | 42/16 |
| 6,658,779 | B2 | 12/2003 | Bauer et al. | 42/1.08 |
| 6,672,218 | B2 | 1/2004 | Oechslin et al. | 102/374 |
| 2003/0136293 | A1 * | 7/2003 | Torsten | 102/439 |
| 2003/0145754 | A1 | 8/2003 | Saxby | |
| 2005/0284325 | A1 * | 12/2005 | Saxby | 102/502 |

FOREIGN PATENT DOCUMENTS

| | | |
|---|---|---|
| WO | WO98/41809 | 9/1998 |
| WO | WO 03/033987 A1 | 4/2003 |
| WO | WO 03/102492 A1 | 11/2003 |

* cited by examiner

NON-LETHAL MARKING BULLET FOR RELATED TRAINING CARTRIDGES

PRIORITY

This application claims the benefit of priority to U.S. provisional patent application No. 60/539,022, filed Jan. 22, 2004 by inventor Rick Huffman. This application is related to United States patent application entitled "Reduced Energy Training Cartridge for Self-Loading Firearms", application Ser. No. 10/799,898, filed Mar. 12, 2004, also by inventor Rick Huffman, which is hereby incorporated by reference.

BACKGROUND

1. Field of the Invention

The invention relates to dedicated or modified non-lethal firearms equipment, and particularly to a non-immobilizing projectile that disperses marking material upon impact with a target.

2. Description of the Related Art

Various designs of non-lethal projectiles exist that are typically tailored to the specific application with which it is to be used. The terms "projectile" and "bullet" are generally used interchangeably herein, although as understood by those skilled in the art, a bullet may be housed within a cartridge in static condition before firing, and become a projectile when launched. A projectile is in a dynamic condition as referred to herein after firing when on its way through the air toward a target prior to impact. The projectile or bullet is in a static condition prior to firing such as when loaded into the chamber of a non-lethal modified or dedicated firearm, or when assembled prior to loading. Applications include paint ball, and in this context, it is desired to have a projectile that marks a human target on impact, but does not cause pain or immobilization. Generally, paint ball rounds are fired in a game setting. They effectively mark targets without causing even moderate pain or injury upon impact. They also have short ranges and inaccurate trajectories that pose highly reduced safety concerns compared with lethal ammunition.

In a paint ball application described at U.S. Pat. No. 5,965,839, which is hereby incorporated by reference, a delivery housing is described for providing trajectory stabilization and distance during delivery of the marking material-filled casing. This extra housing adds an undesirable layer of complexity and cost. It is desired to have a stable non-lethal projectile with adequate range that does not include such a delivery housing containing the marking material-filled casing when the projectile is in the dynamic condition.

The '839 patent and multiple other references describe projectiles including delivery housings that contain one or more casings that are filled with marking material. The casings are often exploded upon impact by a sharpened edge within the delivery housing. In addition to the '839 patent, another example of a projectile uses a sharpened edge or "striker" and is described at U.S. Pat. No. 6,250,226. The striker perforates a container of incapacitating agent upon impact of the projectile with a target. Multiple orifices are provided around a casing that delivers the container to the target along its trajectory for omni-directionally dispersing the incapacitating agent. Other projectiles that include striker components for breaking open a container of fluid under pressure are described at U.S. Pat. No. 6,209,461. These designs using sharpened edges typically have the marking material casing resting nearby raising an clear risk of premature puncture and release of marking material. It is desired to have a multi-function casing that both contains the marking material and provides a stable and aerodynamic delivery mechanism that also forward-disperses the marking material upon impact.

Like these games, some training applications and target practice generally require only that the projectiles mark a target upon impact. Whether or not they would be immobilizing or lethal in nature if they struck a human target may be unimportant, irrelevant, or even undesirable as raising unnecessary safety concerns. However, some non-immobilizing projectile designs have trajectories that may be drastically different than typically higher speed lethal projectiles, and this unsatisfactory. A training aid should allow the training to mimic real conditions as closely as possible while sufficiently subsiding the safety concern to participants' lives inherent in live-fire conditions. It is desired to have a non-lethal projectile that may maintain a stable trajectory similar to that of a non-training immobilizing and perhaps lethal projectile for training and target practice applications.

A very different approach in design for a non-lethal ammunition round is described at U.S. Pat. No. 5,652,407. The design includes multiple parallel and entirely cylindrical projectiles. The projectiles launch simultaneously and tumble through the air toward impact striking the target at various orientations. Marking materials may be impregnated within, coated on or carried by the projectiles. The spread of the strike locations and marked regions is random and broad, e.g., similar to the result of multiple impacts by shotgun shrapnel. Moreover, the trajectories may vary and are likely inaccurate and of short range. It is desired to have a more stable and long range trajectory, and a more concentrated impact and marking material dispersion zone upon impact.

A further application for non-lethal projectiles is riot control. It is typically desired that these projectiles either harm, but not kill, a target person upon impact, or release some form of immobilizing agent, such that either way, the person will be deterred from the further pursuit of rioting. Generally, the marking of targets on impact is not high priority for these applications.

In a baton round for riot control, U.S. Pat. No. 6,371,028 describes a projectile including a casing filled with multiple balls, e.g., steel ball bearings, that redistribute upon impact to soften their effect. The purpose is to deter further rioting without causing serious harm to the targeted person. There is no marking material or other agent within the projectile that disperses upon impact with the target.

U.S. Pat. No. 3,982,489 describes a ring airfoil projectile that is designed to be aerodynamic and to have a high spin rate in a dynamic condition. The ring airfoil design is provided to increase stability, flatten the trajectory and increase the range. Other ring airfoil projectiles are described at U.S. Pat. Nos. 4,270,293 and 4,262,597. The projectiles are ring-shaped, i.e., with hollowed centers. There is no marking material described as being associated with any of these projectiles.

Another non-marking projectile is described at U.S. Pat. No. 5,221,809. The projectile includes a woven bag that fills through a valve with some of the same pressurized propellant that ejects the projectile from a launching device. The bag inflates upon leaving the launcher, which slows the projectile and softens the impact. Another controlled-deformation projectile is described at U.S. Pat. No. 6,302,028 that spreads out at such a diameter that penetration is limited and energy is rapidly spread out by instantaneous enlargement.

Other examples of cartridges including non-lethal projectiles without marking materials, e.g., for training, animal control, or riot control purposes, are described at U.S. Pat. Nos. 6,415,718, 6,564,719, and 6,295,933. Also, U.S. Pat. No. 3,952,662 describes a projectile that may be fired from a conventional shotgun. The projectile may be loaded into a conventional shotgun casing. The projectile has "arms" that extend in dynamic condition to prevent the projectile from penetrating the target. The projectile is described as being filled with buckshot and weights.

At U.S. Pat. No. 5,791,327, a projectile is described as including a base member and point shaped component to form a chamber for holding a disabling agent such as pepper powder or other disabling gas or liquid. A hollow tip and cylindrical body form an inner cavity which is closed after the agent or other substance is inserted. The walls include fracture lines that are designed to break laterally and longitudinally upon impact for causing lateral distribution of the agent. Such fracture lines are formed within casings of projectiles also described at U.S. Pat. Nos. 6,393,992, 6,543,365 and 6,546,874.

Several conventional projectile designs for use with non-lethal firearms and cartridges provide liquid or gaseous expulsion upon impact or are themselves liquid or gaseous and propelled directly from the firearm device. For example, U.S. Pat. No. 5,983,548 describes a non-lethal firearm device for directly ejecting liquids or gases under pressure, but not solid projectiles. The device is described as being designed to propel a debilitating chemical substance such as pepper spray or mace. Another example of liquid or gaseous propulsion firearms is described at U.S. Pat. No. 6,658,779.

Various projectile designs exist that provide marking and immobilization upon impact. For example, U.S. Pat. Nos. 6,230,630 and 6,615,739 describe projectiles that include both marking and immobilizing agents. The projectiles include cylindrical and hemispherical components that are separated by a circular insert to isolate their interior volumes. An embodiment is described wherein, after joining these three components, the marking material is dispensed through a fill port to the interior volume of the hemispherical portion that is subsequently sealed. In another embodiment, marking material is contained within glass ampules that are placed within the interior compartment of the cylindrical component.

Among other examples of conventional technology are a projectile including a transmitter that is used in combination with a reader target as described at U.S. Pat. No. 6,604,946. Another projectile delivers an electrical shock upon impact with a target as described at U.S. Pat. No. 5,962,806. A non-lethal, one- or two-piece projectile is described at U.S. Pat. No. 6,374,741 for being fired from a grenade launcher. A variable lethality projectile is described at U.S. Pat. No. 6,553,913, and a further projectile, although not of non-lethal design, is described at U.S. Pat. No. 6,672,218. All of the patents described above are hereby incorporated by reference into this application for all purposes.

SUMMARY OF THE INVENTION

According to a first aspect of the invention, a projectile of non-lethal composition is provided including one or more components forming an outer casing that is substantially sealed prior to impact with a target both when the projectile is in a static condition and when the projectile is in a dynamic condition providing a concentrated impact zone with the target. A non-toxic marking material is encapsulated within the outer casing prior to impact. The outer casing is configured to deform and unseal upon impact such that the marking material disperses forward via hydraulic action providing a concentrated marking material zone around the impact zone. The casing serves both as an aerodynamic delivery housing and to contain the marking material when the projectile is in the dynamic condition.

The marking material may comprise a paste. When loaded into a cartridge, the projectile may maintain a substantially right cylindrical shape for more than half of its exposed length. The projectile may be configured such that upon impact, deformation produces an unsealing of the casing, and compaction of the casing into the marking material produces the hydraulic action and the forward dispersion. A majority of the outer casing may have a right cylindrical shape. The casing may have an at least in part substantially cylindrical shape.

According to another aspect, a projectile of non-lethal composition may include a cup component and a cap component. The cup component includes a heel portion and a hollowed well portion defining a well cavity. A non-toxic marking material is disposed within the well cavity. The cap component includes an exposed tip portion and a seat portion. The seat portion couples within the well cavity of the cup component and substantially seals the marking material therein prior to impact with a target both when the projectile is in a static condition and when the projectile is in a dynamic condition providing a concentrated impact zone with the target. The marking material marks the impact zone through dispersing the material forward via hydraulic action upon impact providing a concentrated marking material zone around the impact zone.

The one or more components of the first aspect, and/or a projectile in accordance with aspects that follow, may include the cup and cap components, and the projectile according to any of these may further include one or more of the following features. The cap or cup component, or both, may be configured to deform upon impact unsealing the marking material, and the hydraulic action may be produced due to compaction of the cap component into the marking material. The cup component may comprise a heel portion and a hollowed well portion defining a well cavity within which the marking material is disposed prior to impact. The cap component may comprise an exposed tip portion and a seat portion. The seat portion may couple within the well cavity substantially sealing the marking material therein. The heel and well portions of the cup component may have substantially right cylindrical shapes. The heel portion of the cup component may defines an inset cavity opposite the well cavity for coupling with a cartridge protrusion having a flash hole defined therein for communicating pressurized gas from the cartridge to propel the projectile. An outer peripheral interface between the tip and seat portions of the cap component may substantially match an outer periphery of the cup component providing the substantial sealing of the marking material within the well cavity prior to impact. Upon impact, deformation of the cap or cup components, or both, may unseal the marking material at the matching peripheries, and compaction of the cap component into the marking material produces said hydraulic action and forward dispersion. The marking material may be inserted into the well cavity prior to sealing the cup and cap components to form the projectile.

One or more fissures or serrations (hereinafter referred to as "fissures") may be defined between the cap and cup components when the projectile is sealed that facilitate the breaking of the projectile upon impact to release the marking material. The one or more fissures may be filled with the marking material. The one or more fissures may be defined between the seat portion of the cap component and an interior wall of the hollowed portion of the cup, such that the marking material fills a volumetric cavity and the one or more fissures between the cup and cap components when seated within the well cavity prior to impact. An interior surface of the casing that contains the marking material may include the one or more fissures.

In accordance with a further aspect, a projectile of non-lethal composition includes two or more components forming an outer casing that is statically and dynamically stable and substantially sealed prior to impact with a target both when the projectile is in a static condition and when the projectile is in a dynamic condition. A non-toxic marking material is encapsulated within the outer casing prior to impact and configured such that, upon impact, the outer casing deforms and unseals, and the marking material disperses forward via hydraulic action upon impact. The projectile may include any of the other features provided above or below herein.

According to another aspect, a projectile of non-lethal composition includes one or more components forming an in-part substantially cylindrical outer casing prior to impact with a target both when the projectile is in a static condition and when the projectile is in a dynamic condition providing a concentrated impact zone with the target. The casing may be configured such that when loaded into a cartridge, the projectile maintains a substantially right cylindrical shape for more than half of its exposed length. The casing serves as an aerodynamic delivery housing. The casing may define an inset cavity for coupling with a cartridge protrusion having a flash hole defined therein for communicating pressurized gas from the cartridge to propel the projectile. A majority of the outer casing may have a right cylindrical shape. Other features provided above and below herein may also be included.

A method of manufacturing a projectile of non-lethal composition is also provided. The method includes providing two or more components that fit together to form a projectile. The components are configured such that upon coupling, a well cavity is defined therein, as well as one or more fissures leading from the well cavity toward a sealing interface between at least two of the components. A marking material is provided within the well cavity prior to coupling the components. The coupling of the components includes pressurizing the marking material to cause it to flow into the fissures.

DETAILED DESCRIPTION OF THE PREFERRED EMBODIMENTS

Figure 1A:
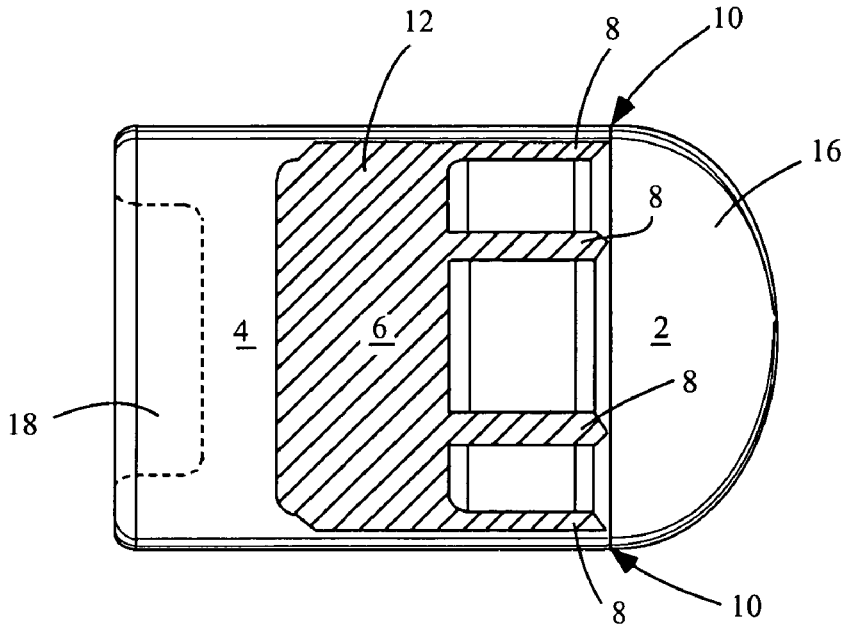
FIG. 1A schematically illustrates a side view through a cavity well outer wall of a multiple component projectile of non-lethal composition in accordance with a preferred embodiment.
Figure 1B:
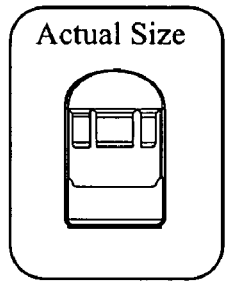
FIG. 1B schematically illustrates a preferred actual size of the projectile of FIG. 1A.

FIG. 1A schematically illustrates a cross-sectional side view of a multiple component projectile of non-lethal composition in accordance with a preferred embodiment. FIG. 1B schematically illustrates a preferred actual size of the projectile of FIG. 1A. The projectile or bullet illustrated at FIGS. 1A and 1B can be produced to accommodate various cartridges (developed or pending development), including both mechanically operating cartridges, e.g., for 9 mm, 0.223, 0.308, etc., and non-mechanically operating cartridges, e.g., 0.38/0.375 cal. revolver, 12 gauge shot shell, etc. In general, the bullet of the invention may be used with any of a wide variety of cartridges and cartridge conditions that work with related applications.

The projectile is formed from three main components: a cap component 2, a cup component 4, and a marking material component 6. The marking material 6 is shown cross-hatched in the drawings facilitating a clearer understanding of locations of the marking material under static, dynamic and impact conditions. The cap component 2 can have any of various shapes known in the art, and generally includes a seat component 14 and a tip component 16. The seat component inserts into a well cavity 12 defined within the cup component 4, while the tip component 16 remains exposed when the projectile is fully assembled. In a preferred embodiment, all or substantially all "air-voids" are omitted when the bullet's cup 4, cap 2, and marking material 6 are assembled, as illustrated at FIGS. 1A and 1B. This features provides a pre-balanced bullet, in the static condition, and improves the dynamic condition, when launched and in-flight, for ballistic stability.

Preferably the shape of the tip 16 is rounded as shown, which is generally more so than a conventional cone-shaped projectile. That is, the projectile of FIG. 1A, when loaded into a cartridge, maintains a substantially right cylindrical shape for more than half of its exposed length. The unexposed length preferably substantially matches the shape of the cavity of the cartridge component (e.g., piston sleeve, see FIG. 4) within which the projectile is to be inserted prior to discharge, and as shown is preferably substantially right cylindrical. The projectile or sleeve interior may include one or more fins. The shape of the tip 16 that is shown in FIG. 1A is preferred over a more cone-shaped or pointed design, because it is desired to have a projectile that is less likely to penetrate a target. This is because it is intended that animate objects such as persons may be targets, and in addition, the marking feature of the projectile will be less effective if the projectile penetrates the target that is intended for marking. The cone-shaped or more pointed design may, however, be alternatively used with various aspects of the invention. Preferred and alternative shapes may be further illustrated at the co-pending patent application by the same inventor, Rick Huffman, entitled, "Reduced Energy Training Cartridge for Self-Loading Firearms", filed Mar. 12, 2004, and which is hereby incorporated by reference, and further alternative shapes may be understood by those skilled in the art or as shown in references cited herein.

FIG. 1A also illustrates multiple fissures (or serrations) 8. The fissures 8 are preferably six in number and generally outside the seat component 14 material of the cap 2. These fissures are preferably internal allowing the outer wall of cup component 4 to remain smooth as to provide greater contact to barrel rifling as desired to create dynamic (bullet spin) stability. These fissures are preferably grooves that are formed in the inner surface of the cup component 4 that facilitate the breaking or splitting of the projectile upon impact with a target for releasing the marking material to mark the target. The fissures 8 may also include grooves formed in the outer periphery of the seat component 14 (see FIG. 2D) of the cap component 2. The fissures 8 may be formed in further alternative ways, as may be understood by those skilled in the art and/or as may be described in references cited herein, that may facilitate the splitting or breaking of the projectile upon impact. FIG. 1 indicates that the marking material 6 fills the fissures 8 due to the lack of cup component material within the fissures 8 and due to the preferred fluidic or quasi-fluidic nature of the marking material. The marking material 6 is preferably a somewhat thick water soluble paste and may be liquid soap or glycerin with tempora added for color. Pressure exerted on the marking material 6 by the seat 14 when the cap 2 is coupled to the cup 4 causes the marking material to flow into and fill or partially fill the fissures 8.

The cup component 4 couples sealably with the cap component 2. The pasty nature of the marking material 6 preferably facilitates the sealing of the cap 2 with the cup 4. The seal may also form suitably as a result of the close fitting diameters of the seat 14 and walls 9 of the well cavity 12, and/or the static frictional force between them when coupled due to the material characteristics and/or shapes. Under the proper conditions, the marking material may be more liquid and less pasty, and yet the sealing of the cap 2 and cup 4 may still be sufficient.

The cup component 4 includes walls 9 that lead all the way to the rim interface 10 of the cap component 2. The cup component 4 includes a well cavity 12 that is filled with the marking material 6. The cup component 4 also includes an inset cavity 18 opposite the well cavity 12 for coupling with a cartridge protrusion having a flash hole defined therein for communicating pressurized gas from the cartridge to propel the projectile (see the cartridge application, incorporated by reference above). The rim interface 10 provides an outer peripheral interface between the tip 16 and seat 14 of the cap component 2 that substantially matches an outer periphery of the walls 9 of the cup component 4 facilitating substantial sealing of the marking material 6 within the well cavity 12 prior to impact. The cap 2 and cup 4 preferably comprise polyethylene or a similar pliable plastic, rubber or other such material.

An alternative bullet or projectile, e.g., for use with inanimate target applications, may exclude the marker material. The projectile may be as described with the well cavity 12 simply remaining void throughout the coupling, launch and impact conditions, or filled with another material such as an immobilizing agent or a paste not having marking capacity. Alternatively, there may simply be no well cavity 12, and the bullet may be a solid single or multiple piece unit. Of course, the usefulness of the fissures 8 for facilitating the breaking of the bullet for releasing the marking material would not exist and so it is not desired to have them. However, if existing supplies of cup and cap components 2, 4 exist, although it may not be desired to mark a target in a particular application, bullets may be formed with cup and cap components 2, 4 as described herein with marking material left out.

Figure 2A:
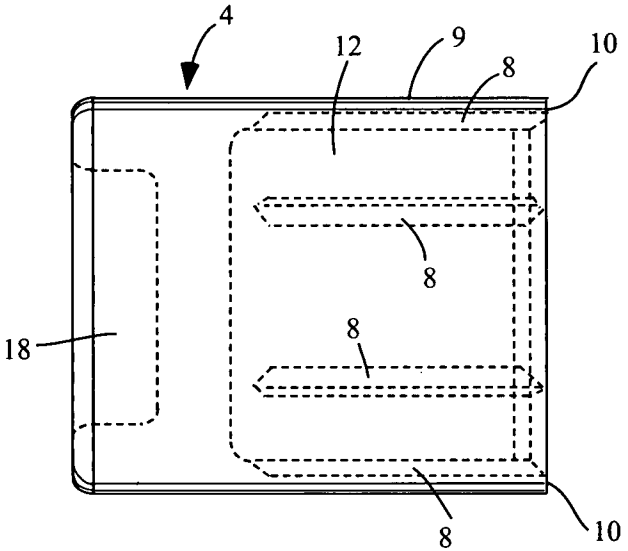
FIG. 2A schematically illustrates a cup component of the projectile of FIGS. 1A-1B.

FIG. 2A schematically illustrates a cup component 4 of the projectile or bullet of FIGS. 1A-1B. In addition to further illustrating the well cavity 12, the inset cavity 18, the rim interface 10 and the walls 9 of the cup component 4, the fissures 8 are illustrated in this view without being filled with the marking material. FIG. 2A illustrates that it is preferred that the fissures 8 comprise grooves that cut into the walls 9 of the cup component 4

Figure 2C:
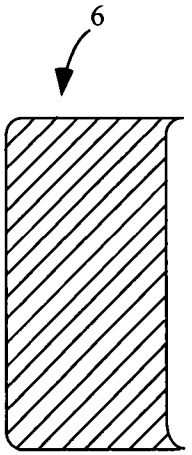
FIG. 2C schematically illustrates a marking material component of the projectile of FIGS. 1A-1B.
Figure 2D:
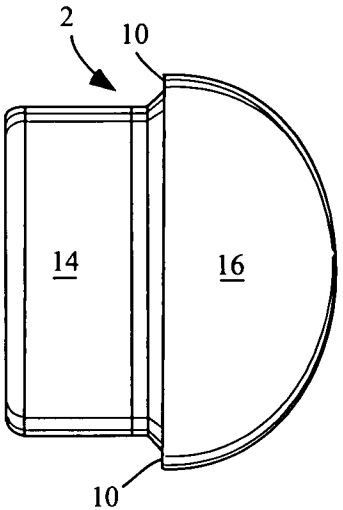
FIG. 2D schematically illustrates a cap component of the projectile of FIGS. 1A-1B.
Figure 2E:
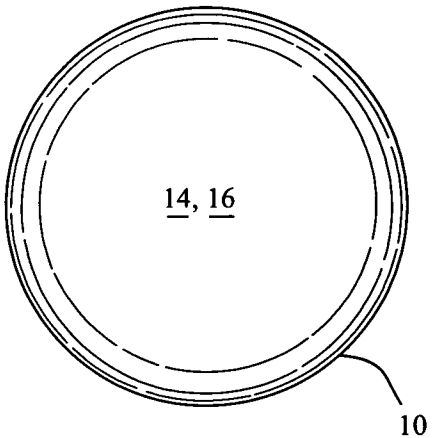
FIG. 2E schematically illustrates a tip end view of the projectile of FIGS. 1A-1B.
Figure 2B:
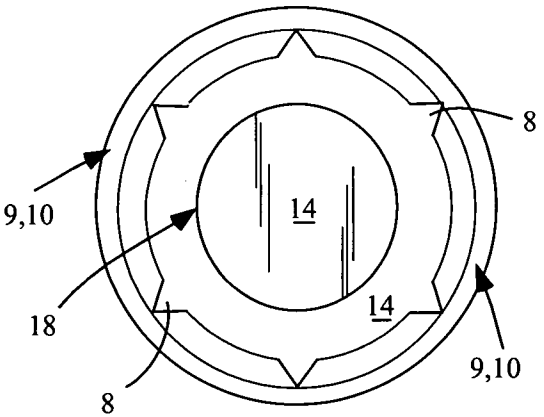
FIG. 2B schematically illustrates an heel end view of the cup component of FIG. 2A.

FIG. 2B schematically illustrates a heel end view of the cup component of the projectile of FIG. 2A. The boundary of the inset cavity 18 is illustrated. At the outer periphery in the heel end view of FIG. 2B, six fissures 8 are shown as is the cup component wall 9. At the very end of the wall 9 is the rim interface 10 of the cup 4 that meets a corresponding rim interface 10 of the cap 2. Fewer or more fissures 8 than six may be provided.

FIG. 2C schematically illustrates a marking material component 6 of the projectile of FIGS. 1A-1B. The marking material 6 is shown before it is pressurized by setting the cap component thereon and flowing to fill the fissures 8 of FIG. 2D.

FIG. 2D schematically illustrates a cap component 2 of the projectile of FIGS. 1A-1B including the seat portion 14, which directly contacts and pressurizes the marking material 6 upon coupling. The tip portion 16 and the rim interface 10 are also shown. The rim interface 10 of the cap component 2 seals with the corresponding rim interface 10 of the cup component 4 upon coupling.

FIG. 2E schematically illustrates a tip end view of the cap component 2 of the projectile of FIG. 2D. In this view, the fissures 8 and cup component wall 9 are illustrated. The inset cavity boundary 18 is not shown in this tip end view so that the extent of the seat component 14 of the cap 2 can be illustrated. The marking material 6 also preferably occupies the space directly below the seat 14, in addition to filling the fissures 8 shown in FIGS. 2A-2B.

Figures 3A, 3B, 3C:
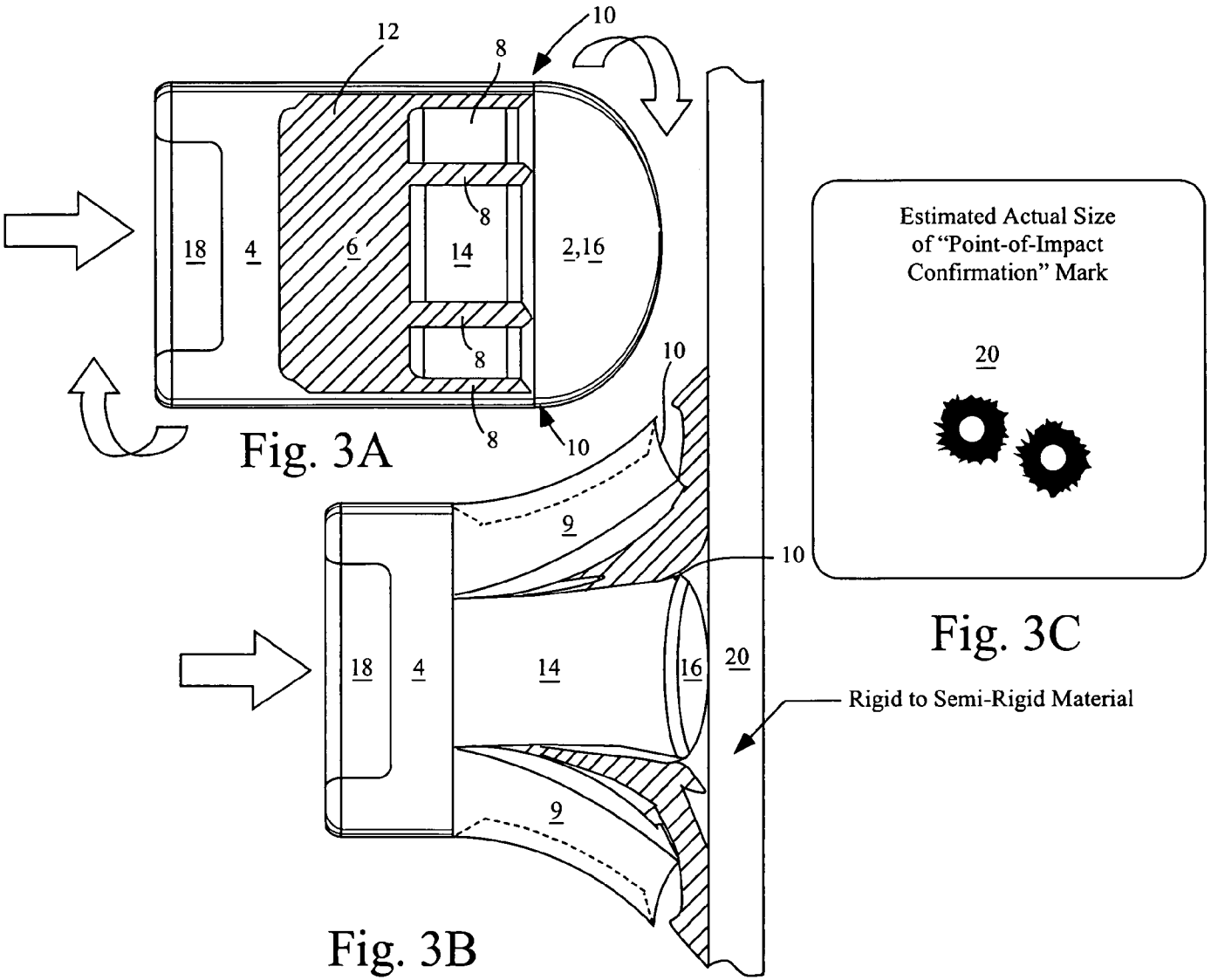
FIG. 3A schematically illustrates the projectile of FIGS. 1A-1B in dynamic condition prior to impact in a view through a cavity well outer wall.
FIG. 3B schematically illustrates the projectile of FIG. 3A with outer casing unsealing and marking material dispersing forward upon impact of the projectile with a target.
FIG. 3C schematically illustrates an estimated actual size of a point-of-impact confirmation mark made on the target of FIG. 3B by marking material.

FIG. 3A schematically illustrates the projectile of FIGS. 1A-1B in dynamic condition prior to impact in the cross-sectional side view of FIG. 1A. The arrows illustrate that the projectile is moving from left to right in the plane of FIG. 3A, and is rotating. FIG. 3B schematically illustrates the projectile of FIG. 3A at impact. The impact force drives the seat portion 14 of the cap 2 deeper into the well cavity 12. In the example of FIG. 3B, the seat portion 14 contacts the solid portion of the cup component 4 at the bottom of the well cavity 12. The outer wall 9 is shown unsealing from the cap 2 at the rim interface 10, and the marking material is shown dispersing forward to the target 20. FIG. 3C schematically illustrates an estimated preferred actual size of a point-of-impact confirmation mark made on the target 20 of FIG. 3B by marking material 6 of the projectile of FIG. 1B.

Figure 4:
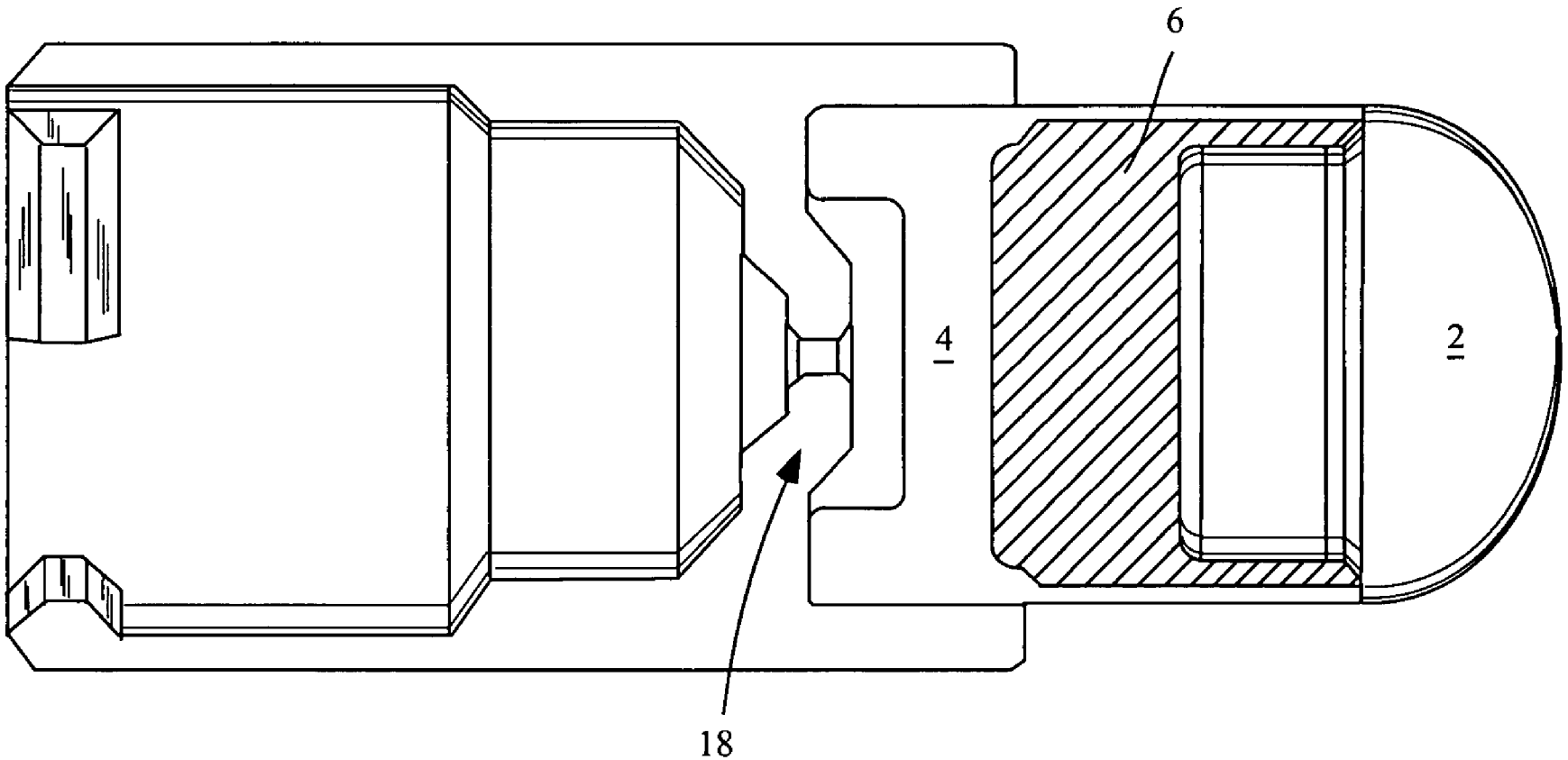
FIG. 4 schematically illustrates a cross-sectional side view of a piston sleeve of a cartridge within which the projectile of FIGS. 1A-3C is inserted revealing the inner structure in accordance with a preferred embodiment.

FIG. 4 schematically illustrates a cross-sectional side view of a piston sleeve of a cartridge within which the projectile of FIGS. 1A-3C may be inserted revealing the inner structure in accordance with a preferred embodiment. The piston sleeve is a component of a preferred two-piece cartridge from which the projectile of FIGS. 1A-3C is launched. The aforementioned cartridge application describes the preferred cartridge in detail. The following is a short summary of features.

A two piece, two-stage, rechargeable, reusable, reduced-energy mechanically operating cartridge is provided for propelling a bullet of non-lethal composition from a dedicated or modified (rendered non-lethal status) firearm. The cartridge unit is comprised of a primary case, a piston sleeve, a propellant unit, and a bullet choice of a solid light weight material for inanimate-target applications or a "marking" version for non-lethal live-target applications such as is preferred herein and as has been described in detail above. The piston sleeve includes a substantially non-deformable jacket defining a bullet housing cavity at a first longitudinal end for coupling the bullet of non-lethal composition therein. The other end couples with the primary case. The primary case also includes a substantially non-deformable jacket for being axially coupled with the piston sleeve. The primary case also defines a cavity for receiving and retaining the propellant unit, a self contained unit consisting of a pyrotechnic material, or for containing pressurized gas or other propellant material. Upon activation, or cartridge discharging, the piston sleeve and primary case "mechanically extend or telescope" (dynamic condition) out from a compressed position (static condition), and thrust the base of the primary case away from the piston sleeve. The piston sleeve and primary case, having not substantially deformed preceding the mechanical operation are manually detached, spent propellant unit removed then replaced with a fresh one (cartridge recharged), the bullet is replaced, and the cartridge is ready for reuse.

According to another aspect, a two-piece, two-stage, rechargeable, reusable, mechanically operating cartridge for propelling a bullet of non-lethal composition from a dedicated or modified (rendered non-lethal status) firearm is provided including a primary case, a piston sleeve, a propellant unit, and a bullet as described herein. The piston sleeve includes a jacket defining a bullet housing cavity, or "mouth" at a first longitudinal end for coupling the bullet therein. The second end of the sleeve, or "throat" couples with the primary case and includes one or more partially annular ridge portions, or "cogs". The primary case also includes a jacket for being axially coupled with the second end of the piston sleeve, and including one or more complementary cogs and/or channels to the cogs of the piston sleeve. The primary case also defines a cavity for coupling with a propellant unit of pyrotechnic compound or for containing pressurized gas or other propellant material. Upon axial coupling and at least partial compression, the primary case and piston sleeve become relatively rotationally movable (cogs traveling in channels) to angularly overlap their respective ridge portions. The angular overlap is present when the piston sleeve and primary case are set into a compressed position. Upon cartridge discharging, when the primary case and piston sleeve are thrust apart in the dynamic condition, the piston sleeve and primary case generally remain coupled within the chamber of the firearm's barrel, although in one aspect, the cogs may be shearable such as to allow separation to reduce energy.

The cogs of the piston sleeve preferably include two or three or more spaced apart cogs or cog portions. The piston sleeve may further include groove portions, or "channels" between the cogs for mating with the complementary cogs of the primary case. These channels may slidably couple with the complementary cogs, corresponding to cog travel within channels.

According to a further aspect, the firearm includes an annular step between the chamber and the barrel. Upon cartridge discharging shoulders of the piston sleeve remain in firm contact with the annular step within the barrel's chamber, while the primary case and sleeve are thrust away from the compressed, static position to a telescoped position. The shoulder of the piston sleeve contact the annular step of the firearm's chamber preventing the sleeve from advancing further within the barrel, such that the piston sleeve and primary case remain coupled within the chamber of the firearm.

An advantageous cartridge preferably includes the above-recited aspects in combination with other aspects. Ultimately upon cartridge discharging, the bullet is propelled down the barrel of the non-lethal status firearm due to propellant pressure releasing through a "regulator" hole that preferably has a selected size or open/close devise for regulating the velocity of the projectile. Moreover, the piston sleeve preferably defines a second cavity at an opposite longitudinal end, i.e., from the end that couples with the primary case, for fitting the bullet therein. The bullet may be configured such that more than half of the length of the bullet which is exposed outside the mouth of the piston sleeve when loaded includes a substantially right cylindrical shape. The mouth of the piston sleeve and the bullet may couple in part due to pressure fittings protruding inwardly from the sleeve, or outwardly from the projectile, or both. The propellant unit cavity and propellant unit may couple in part due to pressure fitting protruding inwardly from the primary case, or outwardly from propellant unit, or both.

A method of preparing a two-piece, two stage, rechargeable, reusable, mechanically operating cartridge including a piston sleeve, a primary case, a propellant unit, and bullet is also provided. A bullet of non-lethal composition is loaded into the mouth defined within the piston sleeve. A propellant unit is loaded into a cavity defined within the primary case or a propellant mechanism is coupled with the cavity. The piston sleeve is axially coupled with the primary case including an initial relative axial displacement of the sleeve and base to bring them together. Cog portions, or partial annular protrusions, of the piston sleeve are coupled with annular channels of the primary base during the initial axial displacement. The piston sleeve and primary case are relatively rotationally displaced after the initial axial displacement such as to prevent direct axial separation. Partially annular channels extend to angularly overlap cogs portions of each of the base and sleeve such that cog portions of the piston sleeve and primary case are angularly overlapped after the relative rotational displacement.

In accordance with another aspect, a method is provided for preparing a two-piece, two stage, rechargeable, reusable, mechanically operating cartridge including a piston sleeve, primary case, propellant unit, and bullet. The bullet of non-lethal composition is loaded into the mouth defined within the piston sleeve. A propellant unit is loaded into a cavity defined within the primary case or another propellant mechanism is coupled with the cavity. The primary base and the piston sleeve are coupled together to form a reduced energy mechanically operating cartridge. The primary base and piston sleeve may be decoupled after cartridge discharging and ejection from the chamber of the firearm. The bullet loading and propellant unit charging or other propellant mechanism coupling, respectively, may be repeated with another bullet configuration and another propellant unit or other propellant mechanism. The coupling may be repeated for reuse of the piston sleeve and primary case in a same cartridge together or in different cartridges.

The methods preferably include reloading another bullet into the mouth defined within the piston sleeve for reuse, and/or recharging with another propellant unit into the cavity defined within the primary case or coupling with further propellant mechanism for reuse. The method preferably includes repeating the bullet loading of the piston sleeve then recharging the primary cartridge with a propellant unit or coupling with another propellant mechanism, and repeating the coupling and rotating steps for reuse of the primary case and piston sleeve in a same mechanically operating cartridge together or in different cartridges. The piston sleeve and primary case of the two-piece cartridge of the reuse step may be reused, respectively, with a different reusable primary base and/or a different reusable piston sleeve.

The methods described preferably further include chambering the mechanically operating cartridge into the dedicated or modified firearm (rendered non-lethal status). The cartridge prior to mechanical activation is considered to be in stage one (static condition). Upon activation, or cartridge discharge, the primary case and piston sleeve preferably "mechanically extend or telescope" considered the second stage (dynamic condition). Ultimately in the second stage, the bullet is propelled down the barrel of the dedicated or modified (non-lethal status) firearm due to propellant pressure releasing through a flash hole regulator that mandates a selected size for regulating the velocity of the projectile. The primary case and the piston sleeve may be configured to be relatively rotationally movable to angularly overlap respective ridge portions. The angular overlap may be present when the piston sleeve and primary case are set into a compressed position (static condition), such that upon cartridge discharging, when the piston sleeve and primary case mechanically extend, the piston sleeve and primary case remain coupled within the chamber of the firearm. As a safety concern piston sleeve cogs are designed to "shear off" if propellant unit or propellant form is manipulated creating "overcharging" of propellant, as such cogs will shear off causing cartridge to separate entirely expelling excessive propellant thus preventing unsafe projectile velocity The firearm may include an annular step between the chamber and the barrel, such that upon firing when shoulder of the piston sleeve are firmly contacting the annular step, the primary case and piston sleeve are telescoped out from a compressed, static position to a telescoped position. The piston sleeve remains in contact with the annular step of the firearm preventing the sleeve from advancing further within the chamber of the barrel. The method may include coupling an annular O-ring protrusion, in addition to the coupling of the cogs and channels, within the throat of the piston sleeve coupled with the primary case stabilize the coupling of the charged mechanically operating cartridge when the two-piece cartridge is in a static position.

While an exemplary drawing and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the arts without departing from the scope of the present invention which is set forth in the claims that follow and includes structural and functional equivalents thereof.

For example, in addition to that which is described as background, the entire descriptions contained in the references cited in the background, the brief description of the drawings, the abstract and the invention summary, U.S. Pat. Nos. 4,899,660, 5,016,536, 5,121,692, 5,219,316, 5,359,937, 5,492,063, 5,974,942, 5,520,019, 5,740,626, 5,983,773, 5,974,942, 6,276,252, 6,357,331, 6,442,882, 6,625,916, 5,791,327, 6,393,992, 6,374,741, 5,962,806, 6,672,218, 6,553,913, 6,564,719, 6,250,226, 5,983,548, 5,221,809, 4,270,293, 6,615,739, 6,230,630, 6,543,365, 6,546,874, 5,965,839, 6,302,028, 6,295,933, 6,209,461, 5,962,806, 3,952,662, 6,658,779, 6,604,946, 6,553,913, 6,415,718, 5,652,407, 5,221,809, 4,270,293, 4,262,597, 3,982,489 and 5,983,773, are hereby incorporated by reference into the detailed description of the preferred embodiments, as disclosing alternative embodiments of elements or features of the preferred embodiments not otherwise set forth in detail. A single one or a combination of two or more of these references may be consulted to obtain a variation of the preferred embodiments described in the detailed description.

In addition, in methods that may be performed according to the claims and/or preferred embodiments herein and that may have been described above and/or recited below, the operations have been described and set forth in selected typographical sequences. However, the sequences have been selected and so ordered for typographical convenience and are not intended to imply any particular order for performing the operations unless expressly set forth in the claims or understood by those skilled in the art as being necessary.

What is claimed is:

1. A projectile of non-lethal composition, comprising:

(a) two or more components forming an outer casing that is substantially sealed prior to impact with a target both when the projectile is in a static condition and when the projectile is in a dynamic condition providing a concentrated impact zone with the target; and (b) a non-toxic marking material encapsulated within the outer casing prior to impact, wherein the outer casing is configured to deform and unseal upon impact such that the marking material disperses forward via hydraulic action providing a concentrated marking material zone around the impact zone, and (c) wherein said casing serves both as an aerodynamic delivery housing and to contain the marking material when the projectile is in the dynamic condition, (d) wherein the outer casing comprises:

(i) a cup component comprising a heel portion and a hollowed well portion defining a well cavity within which the marking material is disposed prior to impact;

(ii) a cap component including an exposed tip portion and a seat portion, the seat portion coupling within and protruding into the well cavity, and thereby displacing a substantial volume of the well cavity, and contacting the marking material therein, and substantially sealing the marking material therein, and wherein the exposed tip portion has a greater radius than the seat portion where they meet forming a shoulder at an outer periphery of the exposed tip portion which serves as a stop by contacting the hollowed well portion of the cup component when the seat portion is fully coupled within the well cavity, thereby forming a sealed well cavity and ending direct exposure of the marking material both to outside ambient air and to sharing the well cavity with a substantial volume of trapped air, and (iii) one or more fissures defined at an interior surface defining the sealed well cavity.

2. The projectile of claim 1, wherein the heel and well portions of the cup component comprise substantially right cylindrical shapes.

3. The projectile of claim 1, wherein the one or more fissures are defined between the seat portion of the cap component and an interior wall of the hollowed portion of the cup, and wherein the marking material fills the substantial volume of the well cavity and the one or more fissures between the cup and cap components when seated within the well cavity prior to impact.

4. The projectile of claim 1, wherein the heel portion of the cup component defines an inset cavity opposite the well cavity for coupling with a cartridge protrusion having a flash hole defined therein for communicating pressurized gas from the cartridge to propel the projectile.

5. The projectile of claim 1, wherein an outer peripheral interface between the tip and seat portions of the cap component substantially matches an outer periphery of the cup component providing the substantial sealing of the marking material within the well cavity prior to impact.

6. The projectile of claim 1, wherein upon impact, deformation of the cap or cup components, or both, unseals the marking material at matching peripheries, and compaction of the cap component into the marking material produces said hydraulic action and forward dispersion.

7. The projectile of claim 1, wherein the marking material is inserted into the well cavity prior to sealing the cup and cap components to form the projectile.

8. The projectile of claim 1, wherein said one or more fissures are configured to facilitate the breaking of the projectile upon impact to release the marking material.

9. The projectile of claim 8, wherein the one or more fissures are filled with the marking material.

10. The projectile of claim 1, wherein the marking material comprises a paste.

11. The projectile of claim 1, wherein when loaded into a cartridge, said projectile maintains a substantially right cylindrical shape for more than half of its exposed length.

12. The projectile of claim 1, wherein the marking material fills a volumetric cavity and the one or more fissures within the substantially sealed casing prior to impact.

13. The projectile of claim 1, configured such that upon impact, deformation produces an unsealing of the casing and compaction of the casing into the marking material produces said hydraulic action and said forward dispersion.

14. The projectile of claim 1, wherein a majority of the outer casing comprises a right cylindrical shape.

15. The projectile of claim 1, wherein the casing comprises an at least in part substantially cylindrical shape.

16. A projectile of non-lethal composition, comprising:

(a) a cup component comprising a heel portion and a hollowed well portion defining a well cavity;

(b) a non-toxic marking material disposed within the well cavity;

(c) a cap component including an exposed tip portion and a seat portion, the seat portion coupling within and protruding into the well cavity of the cup component, and thereby displacing a substantial volume of the well cavity, and contacting the marking material therein, and substantially sealing the marking material therein, and wherein the exposed tip portion has a greater radius than the seat portion where they meet forming a shoulder at an outer periphery of the exposed tip portion which serves as a stop by contacting the hollowed well portion of the cup component when the seat portion is fully coupled within the well cavity, thereby forming a sealed well cavity and ending direct exposure of the marking material both to outside ambient air and to sharing the well cavity with a substantial volume of trapped air prior to impact with a target both when the projectile is in a static condition and when the projectile is in a dynamic condition providing a concentrated impact zone with the target; and (d) one or more fissures defined at an interior surface defining the sealed well cavity, and (e) wherein the marking material marks the impact zone through dispersing the material forward via hydraulic action upon impact providing a concentrated marking material zone around the impact zone.

17. The projectile of claim 16, wherein the cap or cup component, or both, is configured to deform upon impact unsealing the marking material, and said hydraulic action is produced due to compaction of the cap component into the marking material.

18. The projectile of claim 16, wherein when loaded into a cartridge, said projectile maintains a substantially right cylindrical shape for more than half of its exposed length.

19. The projectile of claim 16, wherein the heel and well portions of the cup component comprise substantially right cylindrical shapes.

20. The projectile of claim 16, wherein at least one or a portion of said one or more fissures are defined between the seat portion of the cap component and an interior wall of the hollowed portion of the cup, such that the marking material fills a volumetric cavity and the one or more fissures between the cup and cap components when seated within the well cavity prior to impact.

21. The projectile of claim 16, wherein the heel portion of the cup component defines an inset cavity opposite the well cavity for coupling with a cartridge protrusion having a flash hole defined therein for communicating pressurized gas from the cartridge to propel the projectile.

22. The projectile of claim 16, wherein an outer peripheral interface between the tip and seat portions of the cap component substantially matches an outer periphery of the cup component providing the substantial sealing of the marking material within the well cavity prior to impact.

23. The projectile of claim 16, wherein upon impact, deformation of the cap or cup components, or both, unseals the marking material at matching peripheries, and compaction of the cap component into the marking material produces said hydraulic action and forward dispersion.

24. The projectile of claim 16, wherein the cup and cap components form a casing when sealed that serves both as an aerodynamic delivery housing and to contain the marking material when the projectile is in the dynamic condition.

25. The projectile of claim 16, wherein the marking material is inserted into the well cavity prior to sealing the cup and cap components to form the projectile.

26. The projectile of claim 16, wherein the one or more fissures are defined between the cap and cup components when the projectile is sealed and facilitate the breaking of the projectile upon impact to release the marking material.

27. The projectile of claim 26, wherein the one or more fissures are filled with the marking material.

28. The projectile of claim 16, wherein the marking material comprises a paste.

29. A projectile of non-lethal composition, comprising:

(a) two or more components forming an outer casing that is statically and dynamically stable and substantially sealed prior to impact with a target both when the projectile is in a static condition and when the projectile is in a dynamic condition; and (b) a non-toxic marking material encapsulated within the outer casing prior to impact and configured such that, upon impact, the outer casing deforms and unseals, and the marking material disperses forward via hydraulic action upon impact, wherein when formed by the two or more components, the outer casing comprises:

(i) a heel portion;

(ii) a hollowed well portion defining a well cavity within which the marking material is disposed prior to impact;

(iii) an exposed tip portion, and (iv) a seat portion, the seat portion coupling within and protruding into the well cavity, and thereby displacing a substantial volume of the well cavity, and contacting the marking material therein, and substantially sealing the marking material therein, and wherein the hollowed well portion has a greater radius than the seat portion where they meet forming a shoulder which serves as a stop by contacting the hollowed well portion when the seat portion is fully coupled within the well cavity, thereby forming a sealed well cavity and ending direct exposure of the marking material both to outside ambient air and to sharing the well cavity with a substantial volume of trapped air, and (v) one or more fissures defined at an interior surface defining the sealed well cavity, and (vi) wherein the heel portion, the hollowed well portion and the exposed tip portion together form a closed, aerodynamic outer surface of the outer casing of the projectile.

30. The projectile of claim 29, wherein the two or more components form an in-part substantially cylindrical outer casing.

31. The projectile of claim 30, wherein a majority of the outer casing comprises a right cylindrical shape.

32. The projectile of claim 31, wherein when loaded into a cartridge, said projectile maintains a substantially right cylindrical shape for more than half of its exposed length.

33. The projectile of claim 29, wherein the heel and well portions comprise substantially right cylindrical shapes.

34. The projectile of claim 29, wherein at least one or a portion of the one or more fissures is defined between the seat portion and an interior wall of the hollowed portion, such that the marking material fills a volumetric cavity and the one or more fissures when sealed within the well cavity prior to impact.

35. The projectile of claim 29, wherein the heel portion defines an inset cavity opposite the well cavity for coupling with a cartridge protrusion having a flash hole defined therein for communicating pressurized gas from the cartridge to propel the projectile.

36. The projectile of claim 29, wherein an outer peripheral interface between the tip and seat portions substantially matches an outer periphery providing the substantial sealing of the marking material within the well cavity prior to impact.

37. The projectile of claim 29, wherein upon impact, deformation of at least one of the components unseals the marking material, and compaction of the seat portion into the marking material produces said hydraulic action and forward dispersion.

38. The projectile of claim 29, wherein an interior surface of the casing containing the marking material comprises said one or more fissures, such that the marking material fills a volumetric cavity and the one or more fissures within the substantially sealed casing prior to impact.

39. The projectile of claim 29, configured such that upon impact, deformation unseals the casing and compaction of the casing into the marking material produces said hydraulic action and said forward dispersion.

40. The projectile of claim 29, wherein the outer casing serves both as an aerodynamic delivery housing and to contain the marking material when the projectile is in the dynamic condition.

41. The projectile of claim 29, wherein the marking material is inserted into the well cavity prior to sealing the two or more components to form the projectile.

42. The projectile of claim 29, wherein the one or more fissures between the two or more components when the projectile is sealed facilitate the breaking of the projectile upon impact to release the marking material.

43. The projectile of claim 29, wherein the one or more fissures are filled with the marking material.

44. The projectile of claim 29, wherein the marking material comprises a paste.

* * * * *